US008792801B2

(12) United States Patent
Akamatsu

(10) Patent No.: US 8,792,801 B2
(45) Date of Patent: Jul. 29, 2014

(54) CLEANING DEVICE AND IMAGE FORMING APPARATUS

(75) Inventor: Hiroaki Akamatsu, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 205 days.

(21) Appl. No.: 13/413,246

(22) Filed: Mar. 6, 2012

(65) Prior Publication Data

US 2013/0016993 A1 Jan. 17, 2013

(30) Foreign Application Priority Data

Jul. 11, 2011 (JP) ..... 2011-152887

(51) Int. Cl.
*G03G 15/08* (2006.01)
*G03G 21/00* (2006.01)

(52) U.S. Cl.
USPC ..... 399/102; 399/350

(58) Field of Classification Search
USPC ..... 399/102, 123, 350
IPC ..... G03G 21/0011,2221/1648
See application file for complete search history.

(56) References Cited

U.S. PATENT DOCUMENTS 5,455,665 A * 10/1995 Baba et al. ..... 399/358
6,654,575 B2 * 11/2003 Miura et al. ..... 399/102
6,658,223 B2 * 12/2003 Nishimura et al. ..... 399/102
6,895,198 B2 * 5/2005 Thompson et al. ..... 399/102
8,244,156 B2 * 8/2012 Iwamoto et al. ..... 399/123
8,320,792 B2 * 11/2012 Kawakami et al. ..... 399/102
2003/0099480 A1 5/2003 Nishimura et al.

FOREIGN PATENT DOCUMENTS

JP 01185587 A * 7/1989
JP 2003-167487 A 6/2003
JP 2004085957 A * 3/2004
JP 2007171818 A * 7/2007

* cited by examiner

*Primary Examiner* — Robert Beatty
(74) *Attorney, Agent, or Firm* — Sughrue Mion, PLLC

(57) ABSTRACT

A cleaning device includes a residual-toner accommodation housing having an opening facing toward a post-transfer area of a toner-image bearing member and surrounded by first and second edges and two connecting edges; a residual-toner removing member that overlies the first and connecting edges, has an edge protruding above the opening and abutting on the bearing member, and scrapes off toner from the bearing member toward the housing; a thermoplastic seal member intervening the housing and removing member, having terminal end portions extending along the connecting edges and protruding from the edge, and extending along the first and connecting edges to prevent the toner from leaking through a gap between the housing and removing member; and a sheet-like seal member that covers the second edge, is in contact with the bearing member, and intervenes the bearing member and terminal end portions to prevent the scraped-off toner from leaking from the housing.

6 Claims, 6 Drawing Sheets

CLEANING DEVICE AND IMAGE FORMING APPARATUS

CROSS-REFERENCE TO RELATED APPLICATIONS

This application is based on and claims priority under 35 USC 119 from Japanese Patent Application No. 2011-152887 filed Jul. 11, 2011.

BACKGROUND

Technical Field

The present invention relates to cleaning devices that remove residual toner from post-transfer areas of toner-image bearing members after toner images are transferred therefrom, and to image forming apparatuses equipped with such cleaning devices.

SUMMARY

According to an aspect of the invention, there is provided a cleaning device including a residual-toner accommodation housing, a residual-toner removing member, a thermoplastic seal member, and a sheet-like seal member. The residual-toner accommodation housing has a residual-toner accommodation opening surrounded by a first edge, a second edge, and two connecting edges. The residual-toner accommodation opening faces toward a post-transfer area of a toner-image bearing member that bears a toner image by undergoing a developing process at a development position while rotating about a rotation axis and that transfers the toner image to a transfer object at a transfer position. The first edge and the second edge are opposed to each other and extend in a direction in which the rotation axis extends. The two connecting edges connect corresponding ends of the first edge and the second edge. The residual-toner removing member has an edge that is longer than the first edge. The residual-toner removing member is supported by the residual-toner accommodation housing such that the residual-toner removing member overlies the first edge and areas of the two connecting edges located toward the first edge, and the edge of the residual-toner removing member protrudes above the residual-toner accommodation opening so as to abut on the toner-image bearing member. The residual-toner removing member scrapes off toner remaining on the toner-image bearing member so as to cause the toner to be accommodated in the residual-toner accommodation housing. The thermoplastic seal member is interposed between the residual-toner accommodation housing and the residual-toner removing member and extends along the first edge and along the two connecting edges so as to prevent the toner from leaking through a gap between the residual-toner accommodation housing and the residual-toner removing member. The thermoplastic seal member has terminal end portions that extend along the two connecting edges and that protrude from the edge of the residual-toner removing member. The thermoplastic seal member is applied in a fluid state and subsequently cured, and the thermoplastic seal member in the cured state is deformable in response to external force. The sheet-like seal member is in a form of a sheet and is longer than the second edge. The sheet-like seal member is supported by the residual-toner accommodation housing such that the sheet-like seal member covers the second edge, is in contact with the toner-image bearing member, and is interposed between the toner-image bearing member and the terminal end portions of the thermoplastic seal member protruding from the edge of the residual-toner removing member. The sheet-like seal member prevents the toner scraped off from the toner-image bearing member by the residual-toner removing member from leaking from the residual-toner accommodation housing.

BRIEF DESCRIPTION OF THE DRAWINGS

Exemplary embodiment(s) of the present invention will be described in detail based on the following figures, wherein.

DETAILED DESCRIPTION

An exemplary embodiment of the present invention will be described below.

Figure 1:
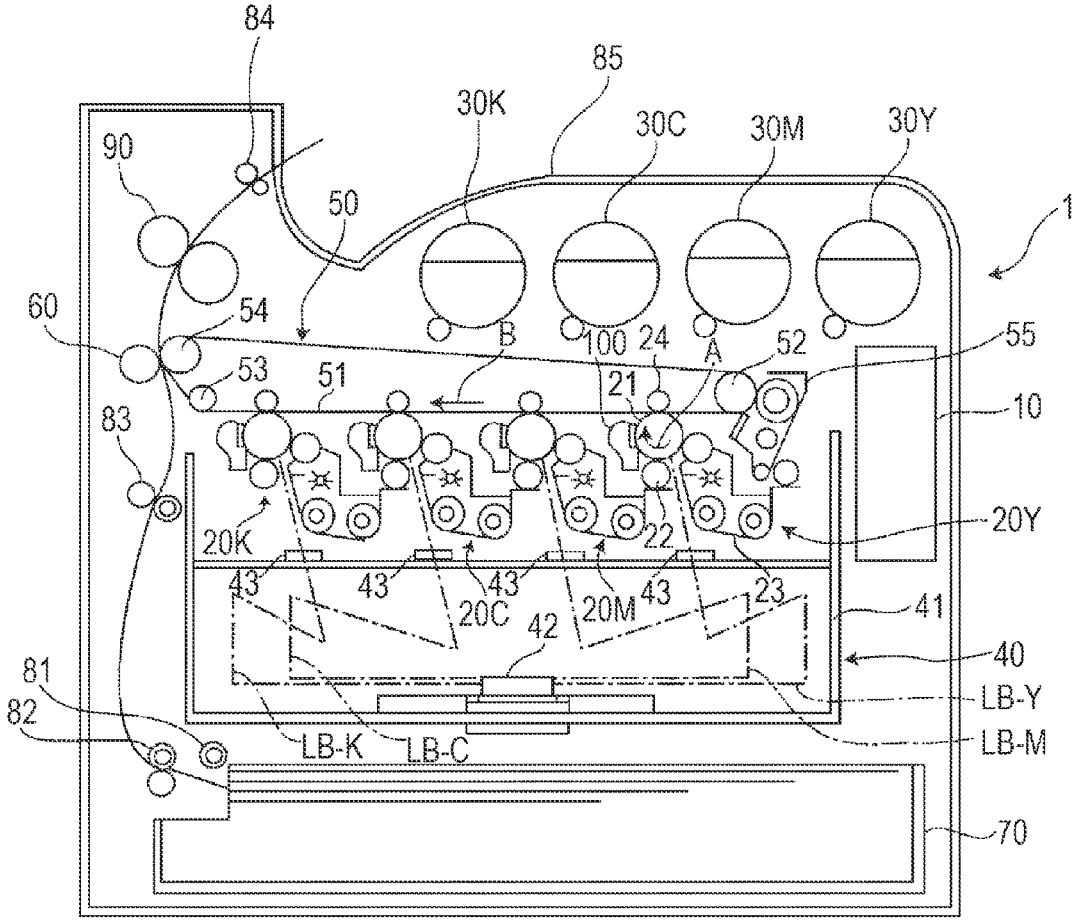
FIG. 1 schematically illustrates the configuration of a printer serving as an image forming apparatus according to an exemplary embodiment of the present invention.

FIG. 1 schematically illustrates the configuration of a printer serving as an image forming apparatus according to an exemplary embodiment of the present invention.

A printer 1 shown in FIG. 1 is equipped with a cleaning device according to an exemplary embodiment of the present invention.

The printer 1 is a so-called tandem-type image forming apparatus that employs an electrophotographic method.

An image signal expressing an image and generated outside the printer 1 is input to the printer 1 via a signal cable (not shown) or the like. The printer 1 includes a controller 10 that controls the operation of various components in the printer 1, and the image signal is input to this controller 10. Under the control of the controller 10, the printer 1 performs image forming operation on the basis of the image signal.

The printer 1 also includes four image forming units 20Y, 20M, 20C, and 20K that form yellow (Y), magenta (M), cyan (C), and black (K) toner images, respectively. The four image forming units 20Y, 20M, 20C, and 20K have the same configuration and are arranged parallel to each other with a fixed distance therebetween in the horizontal direction. With regard to the configuration of the image forming units 20Y, 20M, 20C, and 20K, the following description will representatively be directed to the yellow image forming unit 20Y.

The yellow image forming unit 20Y includes a toner-image bearing member 21 that rotates in a direction indicated by an arrow A. The toner-image bearing member 21 is surrounded by a charger 22, a developing section 23, a first transfer section 24, and a cleaning device 100.

The toner-image bearing member 21 has a shape of a cylinder and rotates about a rotation axis defined by the center of the cylinder. The peripheral surface of the toner-image bearing member 21 acquires electric charge by being electrostatically charged by the charger 22 and releases the electric charge by being exposed to light from an exposure unit 40, to be described below. As a result of this exposure process, an electrostatic latent image is formed on the peripheral surface of the toner-image bearing member 21. The toner-image bearing member 21 corresponds to an example of a toner-image bearing member according to an exemplary embodiment of the present invention.

The exposure unit 40 is disposed below the four image forming units 20Y, 20M, 20C, and 20K. The exposure unit 40 has a frame 41 in which a semiconductor laser (not shown) is disposed. The semiconductor laser emits laser beams LB-Y, LB-M, LB-C, and LB-K, which have been modulated on the basis of the aforementioned image signal, toward the respective image forming units 20Y, 20M, 20C, and 20K. Then, in the exposure unit 40, the laser beams LB-Y, LB-M, LB-C, and LB-K are polarized by a polygonal mirror 42 disposed within the frame 41.

The laser beams LB-Y, LB-M, LB-C, and LB-K travel toward the toner-image bearing members 21 in the respective image forming units 20Y, 20M, 20C, and 20K via glass windows 43 provided on the upper surface of the frame 41. The peripheral surface of each toner-image bearing member 21 is exposed to the corresponding laser beam from the exposure unit 40, whereby an electrostatic latent image is formed on the peripheral surface.

After the formation of the electrostatic latent image, the toner-image bearing member 21 undergoes a developing process performed by the developing section 23 disposed at a development position.

The printer 1 includes toner cartridges 30Y, 30M, 30C, and 30K that supply yellow (Y), magenta (M), cyan (C), and black (K) toners to the developing sections 23 of the respective image forming units 20Y, 20M, 20C, and 20K.

The developing sections 23 of the image forming units 20Y, 20M, 20C, and 20K are supplied with the toners from the toner cartridges 30Y, 30M, 30C, and 30K and perform the developing process on the toner-image bearing members 21 using the supplied toners. As a result of this developing process, toner images are formed on the peripheral surfaces of the toner-image bearing members 21. Each developing section 23 corresponds to an example of a developing unit in the image forming apparatus according to the exemplary embodiment of the present invention.

While the toner-image bearing members 21 bear the toner images, the toner-image bearing members 21 rotate so as to deliver the toner images to the first transfer sections 24. Then, the first transfer sections 24 transfer the toner images on the peripheral surfaces of the toner-image bearing members 21 onto a surface of an intermediate transfer belt 51 in a second transfer unit 50, to be described later. Each first transfer section 24 corresponds to an example of a transfer unit in the image forming apparatus according to the exemplary embodiment of the present invention.

After the toner-image transfer process performed by the first transfer section 24, residual toner remaining in a post-transfer area of each toner-image bearing member 21 is removed by the cleaning device 100. The cleaning device 100 corresponds to an example of the cleaning device according to the exemplary embodiment of the present invention, and also corresponds to an example of a cleaner in the image forming apparatus according to the exemplary embodiment of the present invention. A detailed description of the cleaning device 100 will be provided later.

The printer 1 includes the second transfer unit 50 that superposes the toner images formed in the image forming units 20Y, 20M, 20C, and 20K and transfers the superposed toner image onto recording paper.

The second transfer unit 50 includes the intermediate transfer belt 51, a drive roller 52, a tension roller 53, a backup roller 54, and a cleaning device 55.

The intermediate transfer belt 51 is extended around the drive roller 52, the tension roller 53, and the backup roller 54 while being given certain tension by the tension roller 53. The intermediate transfer belt 51 is rotated in a direction indicated by an arrow B by the drive roller 52. The toner images on the toner-image bearing members 21 of the image forming units 20Y, 20M, 20C, and 20K are sequentially transferred onto the surface of the rotating intermediate transfer belt 51 by the first transfer sections 24. As a result of this sequential transfer process, the toner images of the four colors are superposed on the surface of the intermediate transfer belt 51, whereby a color toner image is formed on the surface of the intermediate transfer belt 51. Due to the rotation of the intermediate transfer belt 51, the color toner image is delivered to a second transfer section 60 disposed facing the backup roller 54. Then, the color toner image is transferred onto transported recording paper, to be described later, by the second transfer section 60.

Residual toner remaining on the surface of the intermediate transfer belt 51 after the second transfer section 60 is removed by the cleaning device 55 included in the second transfer unit 50.

In the printer 1, a paper tray 70 is disposed below the aforementioned exposure unit 40. The paper tray 70 accommodates a stack of recording paper.

Sheets of recording paper are fed from the paper tray 70 by a pickup roller 81. The fed sheets of recording paper are separated in a one-by-one manner by a separation roller 82, and each separated sheet of recording paper is transported upward until the leading edge of the recording paper reaches a standby roller 83. The standby roller 83 has a role of adjusting the transport timing when feeding the recording paper.

The recording paper is fed at a timing adjusted by the standby roller 83 so that the recording paper reaches the second transfer section 60 when the color toner image on the surface of the intermediate transfer belt 51 is delivered to the second transfer section 60.

The color toner image is transferred onto this fed recording paper and is subsequently fixed onto the recording paper by a fixing unit 90 disposed above the second transfer section 60. After the fixing process, the recording paper is output onto a paper output tray 85 by an output roller 84.

The printer 1 in FIG. 1 schematically has the above-described configuration.

Next, the cleaning device 100 included in each of the image forming units 20Y, 20M, 20C, and 20K will be described.

Figure 2:
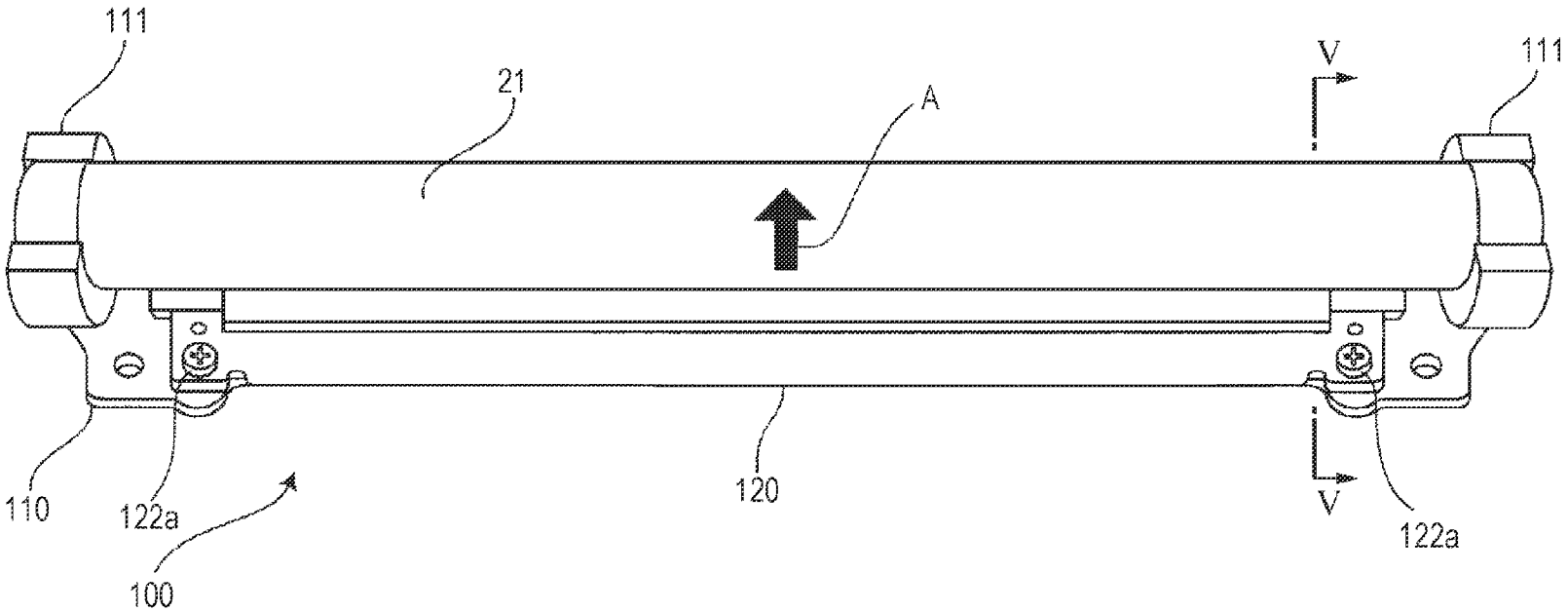
FIG. 2 is a perspective view illustrating each cleaning device shown in FIG. 1 together with a corresponding toner-image bearing member.
Figure 3:
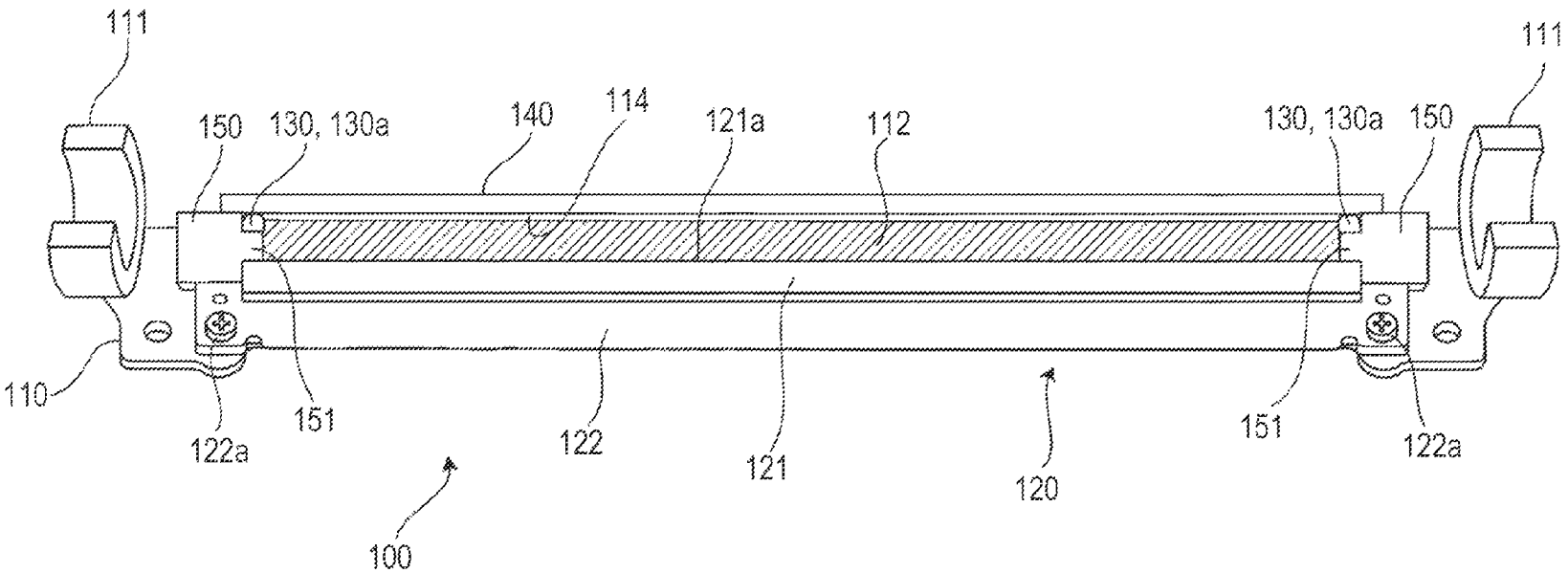
FIG. 3 is a perspective view illustrating the cleaning device without the toner-image bearing member shown in FIG. 2.

FIG. 2 is a perspective view illustrating each cleaning device 100 shown in FIG. 1 together with the corresponding toner-image bearing member 21. FIG. 3 is a perspective view illustrating the cleaning device 100 without the toner-image bearing member 21 shown in FIG. 2.

The cleaning device 100 includes a residual-toner accommodation housing 110 that accommodates the residual toner removed from the post-transfer area of the toner-image bearing member 21 after the toner image is transferred therefrom by the first transfer section 24. In the present exemplary embodiment, the residual-toner accommodation housing 110 has a shape that extends along the rotation axis of the toner-image bearing member 21, and has two supporters 111 that are disposed at opposite ends of the residual-toner accommodation housing 110 and that support the toner-image bearing member 21 in a rotatable manner in the direction of the arrow A also shown in FIG. 1. The residual-toner accommodation housing 110 has a residual-toner accommodation opening 112 between the two supporters 111. The residual-toner accommodation opening 112 faces toward the aforementioned post-transfer area in the peripheral surface of the toner-image bearing member 21 and has a role of receiving the toner removed from the area. The residual-toner accommodation housing 110 corresponds to an example of a residual-toner accommodation housing according to an exemplary embodiment of the present invention.

Furthermore, the cleaning device 100 includes a residual-toner removing member 120 that removes the residual toner from the post-transfer area in the peripheral surface of the toner-image bearing member 21.

Figure 4:
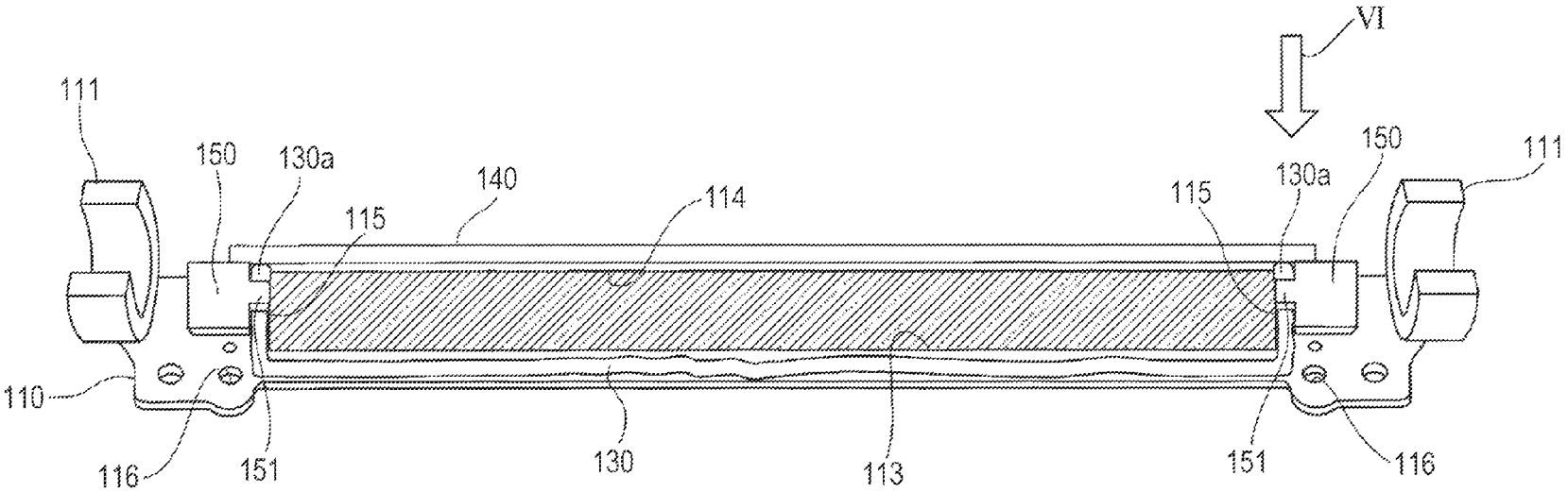
FIG. 4 is a perspective view illustrating the cleaning device from which a residual-toner removing member has been removed.

FIG. 4 is a perspective view illustrating the cleaning device 100 from which the residual-toner removing member 120 has been removed.

The cleaning device 100 will be further described below with reference to FIGS. 2 to 4.

As shown in FIG. 4, the residual-toner accommodation opening 112 in the residual-toner accommodation housing 110 is a rectangular opening that is surrounded by a first edge 113, a second edge 114, and two connecting edges 115. The first edge 113 and the second edge 114 are opposed to each other and extend along the rotation axis of the toner-image bearing member 21 supported by the residual-toner accommodation housing 110. The two connecting edges 115 connect corresponding ends of the first edge 113 and the second edge 114. The residual-toner accommodation opening 112 corresponds to an example of a residual-toner accommodation opening according to an exemplary embodiment of the present invention.

In the present exemplary embodiment, although the residual-toner accommodation opening 112 having a rectangular shape is described as an example of the residual-toner accommodation opening according to the exemplary embodiment of the present invention, the residual-toner accommodation opening according to the exemplary embodiment of the present invention is not limited to this shape and may alternatively have an elliptical shape.

The residual-toner accommodation housing 110 is also provided with two threaded holes 116 (see FIG. 4) for securing the residual-toner removing member 120 shown in FIGS. 2 and 3 by using screws.

The residual-toner removing member 120 has a blade 121 composed of resin and a supporter 122 composed of metal. The blade 121 is fixed to the supporter 122, and the supporter 122 is securely supported by the residual-toner accommodation housing 110 by screwing two screws 122*a* into the aforementioned threaded holes 116.

The blade 121 has an edge 121*a* that is longer than the first edge 113 shown in FIG. 4. Furthermore, the residual-toner removing member 120 having this blade 121 overlies the first edge 113 and areas of the two connecting edges 115 shown in FIG. 4 located toward the first edge 113. The edge 121*a* of the blade 121 protrudes above the residual-toner accommodation opening 112 such that the edge 121*a* abuts on the toner-image bearing member 21 supported by the residual-toner accommodation housing 110. The edge 121*a* scrapes off the toner from the post-transfer area in the peripheral surface of the toner-image bearing member 21. The toner scraped off by the edge 121*a* is received by the residual-toner accommodation opening 112 so as to be accommodated in the residual-toner accommodation housing 110. The residual-toner removing member 120 corresponds to an example of a residual-toner removing member according to an exemplary embodiment of the present invention.

The cleaning device 100 also includes a thermoplastic seal member 130 that prevents the toner accommodated in the residual-toner accommodation housing 110 from leaking through a gap between the residual-toner accommodation housing 110 and the residual-toner removing member 120. The thermoplastic seal member 130 is formed by applying thermoplastic elastomer in a fluid state and then curing the thermoplastic elastomer. The thermoplastic elastomer in the cured state is still deformable in response to external force.

As shown in FIG. 4, the thermoplastic seal member 130 is interposed between the residual-toner accommodation housing 110 and the residual-toner removing member 120 and extends along the first edge 113 as well as along the two connecting edges 115. Terminal end portions of the thermoplastic seal member 130 that extend along the two connecting edges 115 protrude from the edge 121*a* of the blade 121 of the residual-toner removing member 120, as shown in FIG. 3. The thermoplastic seal member 130 corresponds to an example of a thermoplastic seal member according to an exemplary embodiment of the present invention.

The cleaning device 100 also includes a sheet-like seal member 140 that prevents the toner accommodated in the residual-toner accommodation housing 110 from leaking from the second edge 114 side. The sheet-like seal member 140 is a sheet that is longer than the second edge 114 and is bonded to a side surface of the residual-toner accommodation housing 110 proximate to the second edge 114. Specifically, the sheet-like seal member 140 is supported by the residual-toner accommodation housing 110 such that the sheet-like seal member 140 is oriented in a direction that intersects the direction in which the residual-toner accommodation opening 112 is oriented.

Unlike the present exemplary embodiment, the sheet-like seal member 140 supported by the residual-toner accommodation housing 110 may conceivably be oriented in the same direction as the residual-toner accommodation opening 112. However, if the sheet-like seal member 140 were to be supported in this orientation, the residual-toner accommodation housing 110 should be provided with, for example, a bonding margin that extends in the same orientation as that of the residual-toner accommodation opening 112 so that the sheet-like seal member 140 can be bonded to this bonding margin.

Due to not having such a bonding margin, the residual-toner accommodation housing 110 according to the present exemplary embodiment is reduced in size, as compared with the case where the sheet-like seal member 140 is supported in the same orientation as that of the residual-toner accommodation opening 112.

As shown in FIGS. 3 and 4, the sheet-like seal member 140 protrudes beyond the second edge 114 toward the toner-image bearing member 21 supported by the residual-toner accommodation housing 110. When the toner-image bearing member 21 is supported by the residual-toner accommodation housing 110, this protruding part is pressed by the toner-image bearing member 21 and thus extends above the residual-toner accommodation opening 112 so as to cover the second edge 114. In this case, this protruding part of the sheet-like seal member 140 intervenes the toner-image bearing member 21 and terminal end portions 130*a*, which protrude from the edge 121*a* of the blade 121, of the thermoplastic seal member 130. This intervening structure of the sheet-like seal member 140 between the toner-image bearing member 21 and the terminal end portions 130*a* of the thermoplastic seal member 130 will be described in detail later with reference to another drawing. The sheet-like seal member 140 corresponds to an example of a sheet-like seal member according to an exemplary embodiment of the present invention.

The cleaning device 100 further includes two side seal members 150 that prevent the toner accommodated in the residual-toner accommodation housing 110 from leaking from the two sides proximate to the connecting edges 115. The side seal members 150 are made of a felt material.

As shown in FIG. 4, the two side seal members 150 are bonded to areas that are located at the opposite ends of the residual-toner accommodation opening 112 in the upper surface of the residual-toner accommodation housing 110. Specifically, these areas extend along the two connecting edges 115 and are located toward the second edge 114.

As shown in FIG. 3, the side seal members 150 are prevented from overlapping the residual-toner removing member 120 in the extending direction of the second edge 114. On the other hand, the side seal members 150 extend to the second edge 114 from positions where the side seal members 150 overlap the residual-toner removing member 120 in the extending direction of the two connecting edges 115. Furthermore, as shown in FIGS. 3 and 4, the side seal members 150 are each provided with a protrusion 151 that protrudes toward the residual-toner accommodation opening 112. A side surface of the protrusion 151 proximate to the first edge 113 and a side surface of a portion of the side seal member 150 excluding the protrusion 151 extend in conformity to a corresponding corner of the blade 121. Each protrusion 151 partially overlies the corresponding terminal end portion 130*a*, which protrudes from the edge 121*a* of the blade 121, of the thermoplastic seal member 130. The sheet-like seal member 140 intervenes the toner-image bearing member 21 and parts, which protrude from the protrusions 151 of the side seal members 150, of the terminal end portions 130*a* of the thermoplastic seal member 130.

The intervening structure of the sheet-like seal member 140 between the toner-image bearing member 21 and the terminal end portions 130*a* of the thermoplastic seal member 130 will be described below.

Figure 5:
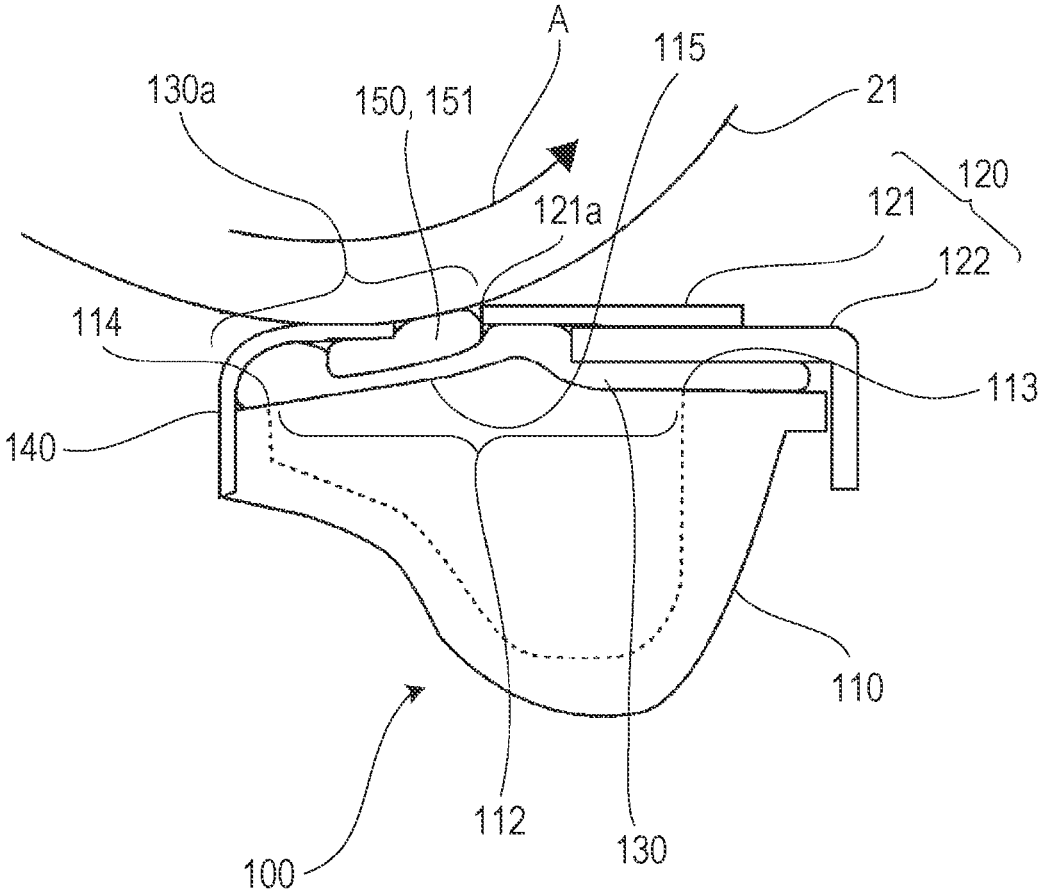
FIG. 5 is a cross-sectional view of the cleaning device taken along line V-V in FIG. 2, illustrating a state where the toner-image bearing member is supported by a residual-toner accommodation housing.

FIG. 5 is a cross-sectional view of the cleaning device 100 taken along line V-V in FIG. 2, illustrating a state where the toner-image bearing member 21 is supported by the residual-toner accommodation housing 110.

As described above, when the toner-image bearing member 21 is supported by the residual-toner accommodation housing 110, the part of the sheet-like seal member 140 that protrudes from the second edge 114 is pressed by the toner-image bearing member 21 and thus extends above the residual-toner accommodation opening 112 so as to cover the second edge 114. The sheet-like seal member 140 that extends above the residual-toner accommodation opening 112 deforms in a direction that is the same as the rotating direction of the toner-image bearing member 21 indicated by the arrow A, so that the deformed shape of the sheet-like seal member 140 is maintained even when the toner-image bearing member 21 rotates.

As described above, the thermoplastic seal member 130 is filled between the residual-toner accommodation housing 110 and the blade 121 of the residual-toner removing member 120, as well as between the residual-toner accommodation housing 110 and the supporter 122 of the residual-toner removing member 120. Portions of the thermoplastic seal member 130 that extend along the connecting edges 115 serve as the terminal end portions 130*a* protruding from the edge 121*a* of the blade 121. Moreover, as described above, areas of the terminal end portions 130*a* proximate to the blade 121 are covered by the protrusions 151 of the side seal members 150. Furthermore, areas of the terminal end portions 130*a* that protrude from the protrusions 151 are covered by the sheet-like seal member 140.

As shown in the cross-sectional view in FIG. 5 and the perspective view in FIG. 3, the first edge 113 of the residual-toner accommodation opening 112 in the residual-toner accommodation housing 110 is covered by the residual-toner removing member 120. The thermoplastic seal member 130 fills the gap between the residual-toner accommodation housing 110 and the residual-toner removing member 120. The second edge 114 of the residual-toner accommodation opening 112 is covered by the sheet-like seal member 140. Furthermore, the two connecting edges 115 of the residual-toner accommodation housing 110 are covered by the opposite ends of the residual-toner removing member 120, the protrusions 151 of the side seal members 150, the thermoplastic seal member 130, and the sheet-like seal member 140.

The edge 121*a* of the blade 121, the protruding part of the sheet-like seal member 140 that extends above the residual-toner accommodation opening 112, and the upper surfaces of the side seal members 150 including the protrusions 151 are set in contact with the peripheral surface of the toner-image bearing member 21.

Due to the elasticity of the thermoplastic seal member 130 in the cured state, the part of the sheet-like seal member 140 that covers the terminal end portions 130*a* of the thermoplastic seal member 130 deforms in conformity to the peripheral surface of the toner-image bearing member 21 so as to be tightly in contact with the peripheral surface.

Accordingly, in the present exemplary embodiment, the gap between the peripheral surface of the toner-image bearing member 21 and all of the edges of the residual-toner accommodation opening 112 is blocked. As a result, the toner in the residual-toner accommodation housing 110 is prevented from leaking therefrom.

Because the thermoplastic elastomer used for forming the thermoplastic seal member 130 is handled in a fluid state, the thermoplastic elastomer can be applied to the residual-toner accommodation housing 110 without man power by using a resin injection device or the like. On the other hand, since the thermoplastic elastomer is very soft even after it is cured, if the thermoplastic elastomer supposedly comes into contact with the peripheral surface of the rotating toner-image bearing member 21, the thermoplastic elastomer may possibly be cut into small pieces due friction and adhere onto the peripheral surface of the toner-image bearing member 21.

In the present exemplary embodiment, the thermoplastic seal member 130 is mostly covered by the residual-toner removing member 120, and the protruding terminal end portions 130*a* are covered by the sheet-like seal member 140. Consequently, the thermoplastic seal member 130 and the peripheral surface of the toner-image bearing member 21 are prevented from coming into contact with each other.

Furthermore, in the present exemplary embodiment, the sheet-like seal member 140 is prevented from overlying the side seal members 150 in the extending direction of the second edge 114 in the following manner.

Figure 6:
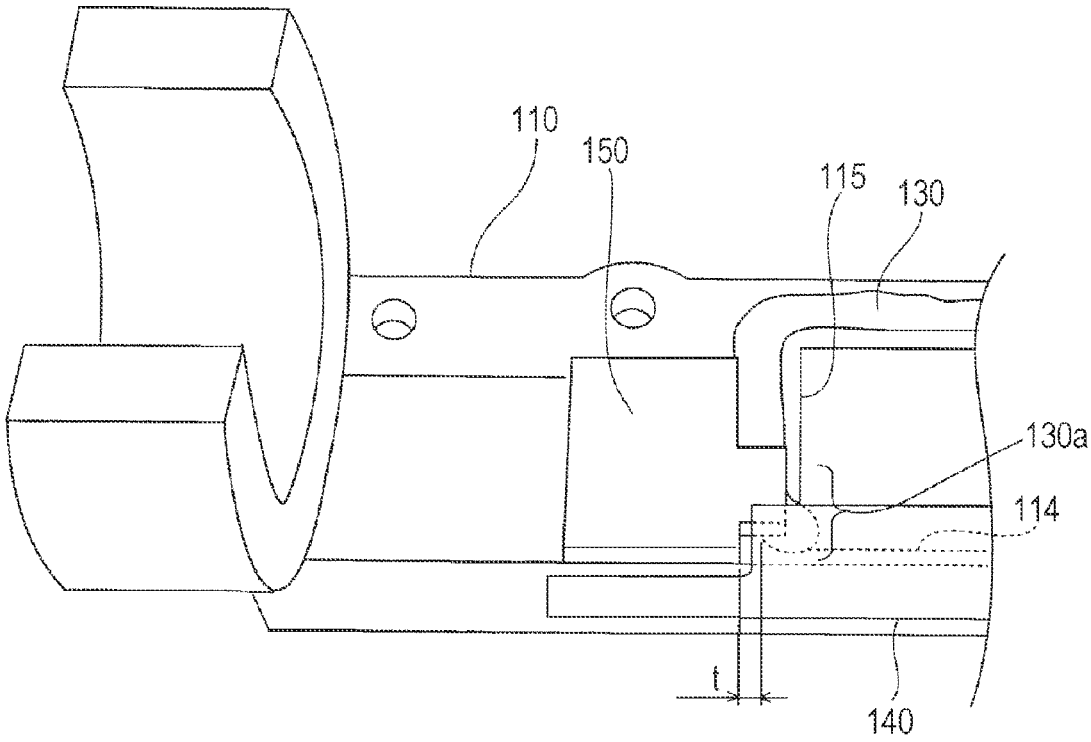
FIG. 6 is an enlarged perspective view of a right end portion of the cleaning device without the residual-toner removing member in FIG. 4, as viewed from a direction indicated by an arrow VI in FIG. 4.

FIG. 6 is an enlarged perspective view of the right end portion of the cleaning device 100 without the residual-toner removing member 120 in FIG. 4, as viewed from a direction indicated by an arrow VI in FIG. 4.

As shown in FIG. 6, the thermoplastic seal member 130 has a shape such that the terminal end portions 130*a* thereof that protrude from the edge 121*a* of the blade 121 (see FIG. 4) extend toward each other and are spaced apart from the two respective side seal members 150 by gaps t.

The sheet-like seal member 140 extends to a position that prevents it from overlying the side seal members 150 in the extending direction of the second edge 114.

If the sheet-like seal member 140 supposedly extends to a position that overlies the side seal members 150 in the extending direction of the second edge 114, when the sheet-like seal member 140 is bent by being pressed by the toner-image bearing member 21, the base of the bent section would come into contact with both the terminal end portions 130*a* of the thermoplastic seal member 130 and the side seal members 150. Because the thermoplastic seal member 130 is softer than the side seal members 150, this would create a difference in the amount of bending between the areas in contact with the terminal end portions 130*a* and the areas in contact with the side seal members 150, possibly forming creases in the sheet-like seal member 140.

As described above, in the present exemplary embodiment, the sheet-like seal member 140 is prevented from overlying the side seal members 150 in the extending direction of the second edge 114. Therefore, of the side seal members 150 and the thermoplastic seal member 130, the aforementioned base of the sheet-like seal member 140 bent along the second edge 114 only comes into contact with the thermoplastic seal member 130. Consequently, the aforementioned creases formed due to the base of the bent section coming into contact with the side seal members 150 are prevented.

Although the present exemplary embodiment is directed to the color printer 1 as an example of the image forming apparatus according to the exemplary embodiment of the present invention, the image forming apparatus according to the exemplary embodiment of the present invention is not limited thereto. For example, the image forming apparatus according to the exemplary embodiment of the present invention may be a monochrome printer, or may be a copier or a facsimile apparatus instead of a printer.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning device comprising:

a residual-toner accommodation housing that has a residual-toner accommodation opening surrounded by a first edge, a second edge, and two connecting edges, the residual-toner accommodation opening facing toward a post-transfer area of a toner-image bearing member that bears a toner image by undergoing a developing process at a development position while rotating about a rotation axis and that transfers the toner image to a transfer object at a transfer position, the first edge and the second edge being opposed to each other and extending in a direction in which the rotation axis extends, the two connecting edges connecting corresponding ends of the first edge and the second edge;

a residual-toner removing member having an edge that is longer than the first edge, the residual-toner removing member being supported by the residual-toner accommodation housing such that the residual-toner removing member overlies the first edge and areas of the two connecting edges located toward the first edge, and the edge of the residual-toner removing member protrudes above the residual-toner accommodation opening so as to abut on the toner-image bearing member, the residual-toner removing member scraping off toner remaining on the toner-image bearing member so as to cause the toner to be accommodated in the residual-toner accommodation housing;

a thermoplastic seal member interposed between the residual-toner accommodation housing and the residual-toner removing member and extending along the first edge and along the two connecting edges so as to prevent the toner from leaking through a gap between the residual-toner accommodation housing and the residual-toner removing member, the thermoplastic seal member having terminal end portions that extend along the two connecting edges and that protrude from the edge of the residual-toner removing member, the thermoplastic seal member being applied in a fluid state and subsequently cured, the thermoplastic seal member in the cured state being deformable in response to external force;

a sheet-like seal member that is in a form of a sheet and is longer than the second edge, the sheet-like seal member being supported by the residual-toner accommodation housing such that the sheet-like seal member covers the second edge, is in contact with the toner-image bearing member, and is interposed between the toner-image bearing member and the terminal end portions of the thermoplastic seal member protruding from the edge of the residual-toner removing member, the sheet-like seal member preventing the toner scraped off from the toner-image bearing member by the residual-toner removing member from leaking from the residual-toner accommodation housing; and two side seal members that are prevented from overlapping the residual-toner removing member in an extending direction of the second edge and that extend to the second edge from positions where the two side seal members overlap the residual-toner removing member in an extending direction of the two connecting edges, the two side seal members being supported by areas of the residual-toner accommodation housing that extend along the two connecting edges, wherein the sheet-like seal member is disposed between the toner-image bearing member and the terminal end portions of the thermoplastic seal member and extends to a position that prevents the sheet-like seal member from overlying the two side seal members in the extending direction of the second edge.

2. The cleaning device according to claim 1, wherein the thermoplastic seal member has a shape such that the terminal end portions thereof that protrude from the edge of the residual-toner removing member extend toward each other in the direction in which the rotation axis extends and are spaced apart from the two respective side seal members by gaps.

3. The cleaning device according to claim 1, wherein the sheet-like seal member is supported by the residual-toner accommodation housing such that the sheet-like seal member is oriented in a direction that intersects a direction in which the residual-toner accommodation opening is oriented, the sheet-like seal member extending above the residual-toner accommodation opening by being in contact with and pressed by the toner-image bearing member so as to cover the second edge.

4. The cleaning device according to claim 2, wherein the sheet-like seal member is supported by the residual-toner accommodation housing such that the sheet-like seal member is oriented in a direction that intersects a direction in which the residual-toner accommodation opening is oriented, the sheet-like seal member extending above the residual-toner accommodation opening by being in contact with and pressed by the toner-image bearing member so as to cover the second edge.

5. An image forming apparatus comprising:

a toner-image bearing member that bears a toner image by undergoing a latent-image forming process and a developing process at a development position while rotating about a rotation axis and that transfers the toner image to a transfer object at a transfer position;

a developing unit that develops a latent image on the toner-image bearing member at the development position so as to cause the toner-image bearing member to bear the toner image;

a transfer unit that transfers the toner image on the toner-image bearing member onto the transfer object at the transfer position; and a cleaner that removes residual toner from a post-transfer area of the toner-image bearing member after the toner image is transferred therefrom by the transfer unit, wherein the cleaner includes a residual-toner accommodation housing that has a residual-toner accommodation opening surrounded by a first edge, a second edge, and two connecting edges, the residual-toner accommodation opening facing toward the post-transfer area of the toner-image bearing member, the first edge and the second edge being opposed to each other and extending in a direction in which the rotation axis extends, the two connecting edges connecting corresponding ends of the first edge and the second edge, a residual-toner removing member having an edge that is longer than the first edge, the residual-toner removing member being supported by the residual-toner accommodation housing such that the residual-toner removing member overlies the first edge and areas of the two connecting edges located toward the first edge, and the edge of the residual-toner removing member protrudes above the residual-toner accommodation opening so as to abut on the toner-image bearing member, the residual-toner removing member scraping off toner remaining on the toner-image bearing member so as to cause the toner to be accommodated in the residual-toner accommodation housing, a thermoplastic seal member interposed between the residual-toner accommodation housing and the residual-toner removing member and extending along the first edge and along the two connecting edges so as to prevent the toner from leaking through a gap between the residual-toner accommodation housing and the residual-toner removing member, the thermoplastic seal member having terminal end portions that extend along the two connecting edges and that protrude from the edge of the residual-toner removing member, the thermoplastic seal member being applied in a fluid state and subsequently cured, the thermoplastic seal member in the cured state being deformable in response to external force, a sheet-like seal member that is in a form of a sheet and is longer than the second edge, the sheet-like seal member being supported by the residual-toner accommodation housing such that the sheet-like seal member covers the second edge, is in contact with the toner-image bearing member, and is interposed between the toner-image bearing member and the terminal end portions of the thermoplastic seal member protruding from the edge of the residual-toner removing member, the sheet-like seal member preventing the toner scraped off from the toner-image bearing member by the residual-toner removing member from leaking from the residual-toner accommodation housing; and two side seal members that are prevented from overlapping the residual-toner removing member in an extending direction of the second edge and that extend to the second edge from positions where the two side seal members overlap the residual-toner removing member in an extending direction of the two connecting edges, the two side seal members being supported by areas of the residual-toner accommodation housing that extend along the two connecting edges, wherein the sheet-like seal member is disposed between the toner-image bearing member and the terminal end portions of the thermoplastic seal member and extends to a position that prevents the sheet-like seal member from overlying the two side seal members in the extending direction of the second edge.

6. The image forming apparatus of claim 5, wherein the thermoplastic seal member has a shape such that the terminal end portions thereof that protrude from the edge of the residual-toner removing member extend toward each other in the direction in which the rotation axis extends and are spaced apart from the two respective side seal members by gaps.

* * * * *